United States Patent [19]

Medovar et al.

[11] 4,088,295

[45] May 9, 1978

[54] MOULD FOR ELECTROSLAG CASTING OF FACETED METAL INGOTS

[76] Inventors: Boris Izrailevich Medovar, ulitsa Anri Barbjusa, 22/26, kv. 109; Viktor Alexeevich Efimov, ulitsa Vladimirskaya, 53/51, kv. 88; Viktor Lvovich Shevtsov, ulitsa Saxagonskogo, 35, kv. 6; Viktor Leonidovich Artamonov, ulitsa Shumskogo, 8[a], kv. 90; Alexei Georgievich Bogachenko, ulitsa Miljutenko, 15/2, kv. 141; Georgy Sergeevich Marinsky, ulitsa Tatarskaya, 1[b], kv. 19; Vitaly Ivanovich Sagan, ulitsa Kaunasskaya, 4/1, kv. 22; Jury Pavlovich Shtanko, ulitsa Ezhena Potie, 9, kv. 92; Richard Yakubovich Yakobshe, ulitsa Kablukova, 11, kv. 36, all of Kiev, U.S.S.R.

[21] Appl. No.: 760,026

[22] Filed: Jan. 17, 1977

[51] Int. Cl.[2] ..... B22D 7/06; B22D 27/04

[52] U.S. Cl. ..... 249/79; 164/252; 164/348; 164/418; 164/443; 249/174

[58] Field of Search ..... 249/174, 204, 206, 79, 249/80, 81, 82; 164/52, 252, 283 M, 82, 273 R, 89, 123, 348

[56] References Cited

U.S. PATENT DOCUMENTS

| | | | |
|---|---|---|---|
| 1,555,626 | 9/1925 | Black | 249/174 X |
| 1,973,374 | 9/1934 | Farabaugh | 249/174 X |
| 2,895,189 | 7/1959 | Maertens | 249/82 X |
| 3,346,037 | 10/1967 | Bungeroth | 164/273 R |

FOREIGN PATENT DOCUMENTS

| | | | |
|---|---|---|---|
| 859,610 | 1/1961 | United Kingdom | 164/283 M |

*Primary Examiner*—Francis S. Husar
*Assistant Examiner*—John S. Brown
*Attorney, Agent, or Firm*—Lackenbach, Lilling & Siegel

[57] ABSTRACT

A mould for the electroslag casting of faceted metal ingots has longitudinal flutes on the internal surfaces of at least two walls thereof. The depth of these flutes decreases in a horizontal direction from the middle of the walls to the corners of the mould chamber.

6 Claims, 8 Drawing Figures

MOULD FOR ELECTROSLAG CASTING OF FACETED METAL INGOTS

The present invention relates to electrometallurgy, and more particularly, to moulds for the electroslag casting of faceted metal ingots.

The invention can be used most effectively during remelting of metals, for removing impurities (such as sulphur, non-ferrous inclusions, etc.) from metals, and for casting quality ingots free from defects caused by liquation and shrinkage.

Such a mould is made as a metal container with double walls, whose melting chamber has usually the shape of the ingot to be cast.

The internal wall facing the melting chamber is made of a metal with high heat conductivity (such as copper, for instance).

The external wall is made of steel and serves as a bearing structure. There is a gap between the two walls with a coolant circulating there within. The coolant used here is water.

The mould is provided with suitable piping for the delivery and withdrawal of said coolant, with collectors used for the uniform distribution of the water along the perimeter of the walls and with stiffening ribs used to prevent or reduce the distortion of the internal wall caused by the melting-chamber thermal effects.

Ingot moulds are often built so that coolant moves through channels (circular, rectangular or annular) made in the internal walls, rather than through the gap between the external and internal walls.

In Such (channel-type) moulds the external and internal walls are held tight against each other by means of bolts, studs, etc.

The moulds for casting ingots whose shape is other than round are built of separate plates which may have joint faces either in horizontal or vertical planes. These plates are connected to each other, thereby forming a melting chamber.

The electroslag casting process is effected in the simplest way by charging the metal to be remelted into the melting chamber of the mould, the latter being mounted stationary on a cooled baseplate.

One or a plurality of electrodes are introduced into the mould, a slag bath is prepared therein by one of the conventional methods, and electric current is passed therethrough.

Heat is generated in the slag bath due to the ohmic resistance of the layer of liquid slag; part of this heat melts the metal.

The molten metal passes through the layer of liquid slag, and being refined on its way it accumulates in the lower part of the mould, wherein it solidifies owing to intensive heat removal, and so forms an ingot.

As the mould is filled with the molten metal, the slag level rises. A lining of solidified slag evolves in the region of the slag bath, subsequently separating the ingot being formed from the mould walls. The thickness of said slag lining depends on the amount of the heat generated and removed in the process and may vary not only with changing the ingot size but also with the change in the melting conditions.

The solidified slag lining features a low heat conductivity, it reduces the removal of heat from the ingot and makes for its smooth surface.

In the upper part of the ingot, the metal is in a liquid state and forms a liquid metal bath which, in its upper region is separated from the slag lining by a skin of solidified metal. The thickness of this skin also depends on the ratio between the amount of supplied and removed heat and it grows with increased distance from the uppermost level of the liquid metal bath.

The upper surface of the liquid metal bath forms a meniscus at the slag lining. With excessive heat removal (or inadequate heat supply) the interface of the liquid and solid metal phases may come up to the meniscus and develop a crimp or a nick on the ingot surface.

For this reason, the adequate heat evolution is required within the mould that allows a good ingot surface to be obtained at minimum depth of the metal bath.

The aforesaid method of ingot casting suffers from considerable disadvantages.

First, it requires ingot moulds whose height exceeds the height of the ingots to be obtained. Where large-sized ingots are to be produced, a mould therefor which can adequately resist the effects of the heat evolved in melting is very difficult to engineer.

Second, a stationary mould requires electrodes whose cross-section area is smaller than the passage area of the mould melting chamber, i.e. the mould space factor (which is the ratio between the electrode's and the mould chamber's cross-section areas) is under 1. To produce high-quality electrodes with a space factor of about 1 (say, 0.8–0.9) for use in large-ingot casting has proved imparacticable, and electrodes for remelting with a space factor there of about 0.4 to 0.7 must be much longer, which results in increased overall dimensions of the whole casting installation.

These disadvantages are eliminated by the use of an arrangement wherein the ingot being cast is moved relative to the mould. Here, as the ingot is formed, it is moved relative to the mould by one of the conventional methods so that the liquid metal surface is maintained at a constant level with reference to the upper endfaces of the mould walls.

That makes it possible to use moulds whose height is much smaller than that of the ingots being cast.

Such moulds are fairly simple to produce. In addition, the casting method wherein the ingot is moved relative to the mould allows the use of a mould with a wider upper part, wherein the slag bath is situated.

In this case, several short electrodes can be used whose space factor, as taken with reference to the main, forming part of the mould chamber, can be as great as 1 and even greater.

However, in the process of the relative movement the ingot being cast slides along the walls of the mould, the metal skin separating the liquid metal bath from said walls and the slag lining are both subject to tensile stress. Under certain conditions, which may arise, said metal skin or said slag lining may break.

At these spots the ingot may develop dents, cracks, and other surface defects, which downgrades such ingots and calls for the subsequent machining thereof.

Faceted ingots are particularly liable to such defects since it is impossible to provide uniform heat evolution along the perimeter of the walls in the moulds used therefor.

The central portions of said walls are in the regions with higher heat evolution as compared with the chamber corners, where the heat evolution is lower. That results in the ingots' crimped corner areas.

To prevent crimping in the casting of faceted ingots, the power consumption used here is substantially higher than that in the casting of round ingots of equal cross-section areas.

Increased power consumption, however, results in the over heating of the metal in the region of the walls' central portions. As a result, the metal skin already formed becomes thinner and tends to break as the ingot moves relative to the mould.

To prevent the disruption of said skin of solidified metal and said lining of solidified slag, it is necessary to increse the strength thereof.

Known in the prior art is a mould for the continuous casting of faceted steel ingots, wherein four separate plates, connected to each other by means of studs, form the walls of the mould. The chamber of such a mould is of a rectangular cross section with a ratio of the wide to narrow sides being over 2:1.

Channels for a coolant (water) are fitted within the walls.

The internal surfaces of both wide walls are provided with longitudinal flutes in the form of undulations defined by circle arcs, the radii of the arcs facing the central portion of the wall being smaller than those of the arcs facing the side portions thereof.

These flutes are made 2 to 4 mm deep with a spacing of 20 to 50 mm.

The mould is mounted vertically, and the ingot slides down its walls along the flutes. The ingots cast in this mould have the identical flutes, formed by the walls.

This shape of the walls' internal surfaces makes for better heat removal from the ingot being cast due to the better contact of the metal skin with the fluted surface of the mould wall. The thickness of said metal skin increases, and the strength of the fluted skin thus formed is much higher than that of a planar skin.

Moreover, the projections of the walls' flutes make up additional supports for the metal skin, which also strengthens it.

In the moulds for electroslag casting of faceted metal ingots, however, the type of fluted walls described above cannot be used because such walls feature increased heat removal over the whole of their surfaces, even in the corner zones. This increased heat removal in the corners of the mould chamber promotes the formation of crimps and nicks on the ingot surface.

In addition, the movement of the ingot being cast relative to the mould in the course of electroslag casting is carried out at a rate which is about one-tenth of that used in said continuous casting of steel ingots.

While moving, the ingot shrinks considerably and tends to stick in the corner flutes. That impairs the relative movement and may cause the jamming of the ingot in the mould.

The main object of the present invention is to provide a mould for the electroslag casting of faceted metal ingots which would ensure the formation of said slag lining and said metal skin of a shape which increases their strength.

Another, equally important object of the invention is to provide a mould for the electroslag casting of faceted metal ingots which prevents the jamming of the ingot in the flutes of the moulds lower part at the beginning of casting.

Still another object of the invention is to provide a mould for the electroslag casting of faceted metal ingots which ensures normal shrinkage of the ingot during its movement along the walls of said mould and the high-quality defect-free surface of the ingot.

These and other objects of the present invention are attained by the provision of a mould for the electroslag casting of faceted metallic ingots having longitudinal flutes on the internal surfaces of at least two of its walls wherein, according to the present invention, the depth of said flutes decreases in a horizontal direction from the middle of the walls to the mould corners.

This results in a better defect-free ingot surface and ensures normal shrinkage of the ingot during its movement along the walls of the mould.

In addition, the mould according to this invention provides the formation of a slag lining and a metal skin of the shape that makes for higher strength thereof and that ensures greater thickness thereof in the central part of the mould.

Moreover, this arrangement of a mould according to the present invention prevents the ingot being cast from jamming in the flutes of the mould's lower part at the beginning of casting.

It is expedient to have the depth of the flutes decreasing gradually.

That provides a gradual decrease in heat removal from the central portion of the walls to the mould corners and thereby improves the surface of the ingot.

It is desirable that the flutes on the central portions of the walls should be 1.1 to 5 times deeper than those on the side portions thereof.

This ratio ensures the best quality of the ingot surface.

It is preferable that the flutes on the mould walls should be situated in the zone where the ingot being cast contacts said walls.

That makes it possible to reduce the volume of machining when making flutes on the walls of the mould.

It is advantageous that the flutes of the minimum depth be made on the walls at a distance from the mould corners ranging from 0.05 to 0.4 of the wall width.

That provides reliable movement of the ingot relative to the mould.

It is advisable that said flutes should be made with a spacing which in the upper part of the mould is greater than in its lower part.

That prevents the ingot being cast from jamming in the flutes of the moulds lower part at the beginning of casting.

Therefore, a mould according to the present invention provides the formation of a slag lining and a metal skin of a shape which has high strength.

In addition, said mould prevents the jamming of the ingot being cast in the flutes of the lower part thereof at the beginning of casting and provides its normal shrinkage as it moves along the mould walls.

Moreover, said mould provides the high-quality defect-free surface of the ingots cast therein.

The present invention will now be described by way of example with reference to the accompanying drawings, wherein.

Figure 1:
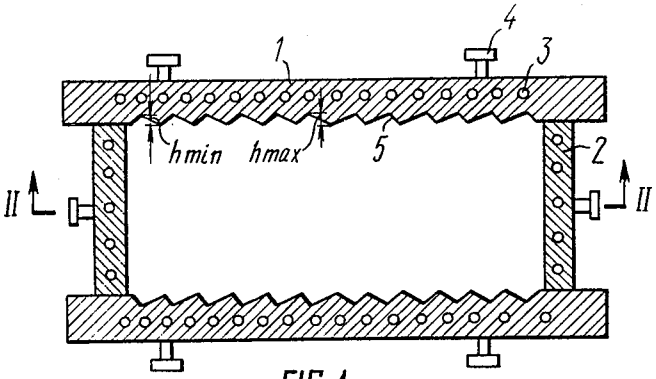
FIG. 1 shows a section taken in a horizontal plane of a mould for the electroslag casting of faceted metallic ingots according to the present invention, wherein flutes are made on two wider walls.

The ingot mould, according to the invention shown in FIG. 1 has four walls, of which two walls 1 have one width, and the other two walls 2 have another width.

Each of said walls 1 and 2 is provided with channels 3 for a coolant.

Figure 2:
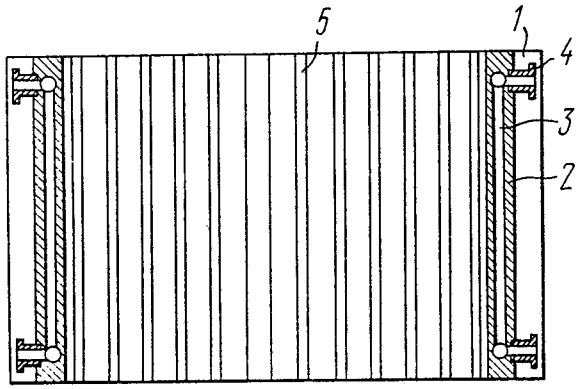
FIG. 2 is a section along the line II–II in FIG. 1.

The supply and removal of the coolant are effected through pipes 4 (FIG. 2).

The internal surfaces of the wider walls 1 are provided with longitudinal flutes 5.

The flutes 5 (FIG. 1) can be formed by saw-like ribs or undulations either symmetrical relative to their apexes or otherwise.

In this embodiment of the invention, the flutes 5 have a depth central portion to the corners of which gradually decreases in a horizontal direction from the wall the mould. This provides a gradual decrease in heat removal from the central portions of the walls 1 to the mould corners.

The mould operates as follows.

It is installed on an electroslag remelting furnace, a water-cooled baseplate with a device for holding the ingot is placed under the mould, and one or several consumable electrodes are introduced therein (the furnace, the mould baseplate with a holding device, and the electrodes are not shown).

A slag bath is prepared in the mould by one of the conventional methods, and electric current is passed therethrough. The heat evolved from the slag melts the electrodes, the metal passes through the layer of the slag and accumulates on the mould baseplate. Heat removal causes the metal to solidify and form an ingot.

A lining of solidified slag is formed on the mould walls in the zone of the slag bath. The shape of said lining matches the shape of the flutes. This slag lining separates the ingot being formed from the walls of the mould. The shape of the ingot surface reflects that of the mould walls, with the corresponding skin of solidified metal developing in the upper part of the ingot. This metal skin grows thicker owing to the increased heat removal in the flutes, with the heat being removed more intensively from the zone of higher heat evolution. As the mould is filled with the molten metal, the upper surface thereof rises to the level at which movement of the ingot relative to the mould is to begin. This level is controlled by one of the conventional methods. Said relative movement is effected by means of a stripping mechanism (not shown).

During the movement, the slag lining and the metal skin are subjected to tensile stress, but since they become stronger owing to the flutes these skins do not break. The smaller depth of the flutes near the corners of the mould results in decreased heat removal thereat. Hence, the coolest parts of the ingot develop no crimps and the ingot thus obtained has a high-quality surface.

Figure 3:
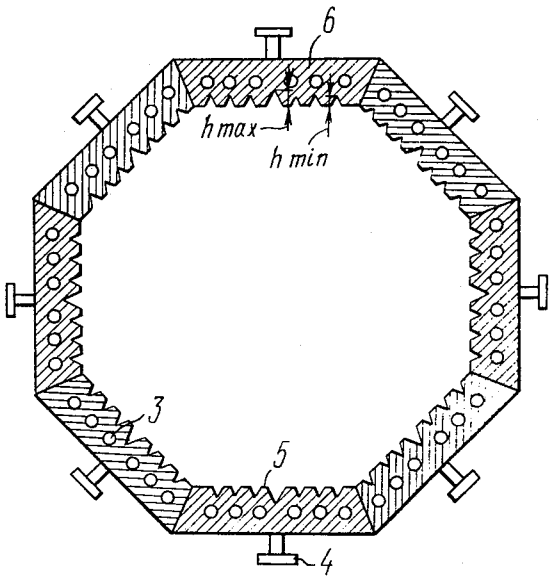
FIG. 3 is a section in a horizontal plane of a mould, according to this invention, wherein the flutes are made on all its walls.

FIG. 3 shows an ingot mould according to the invention which has eight cooled walls 6 of equal width with channels 3 provided therein for receiving a coolant. The coolant is supplied to and removed from the walls through pipes 4. The internal surface of each wall 6 is provided with flutes 5 being symmetrical relative to their appexes.

The flutes 5 located on the middle of each wall are three times deeper than those located on the sides thereof. This ratio, however, can range from 1,1 to 5.

The mould operates in a manner similar to that described above.

Figure 6:
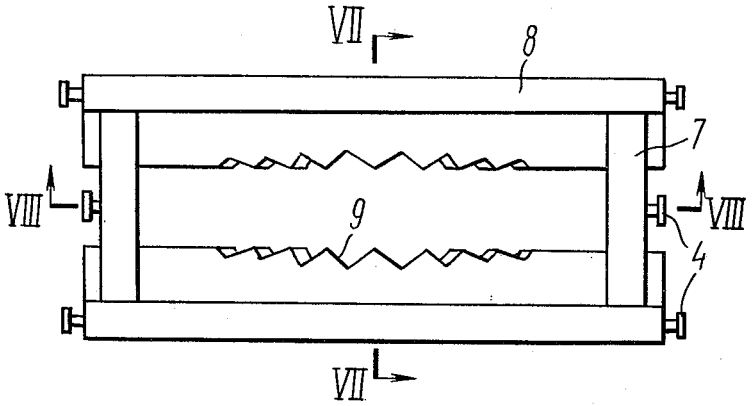
FIG. 6 is a mould, according to the present invention, wherein the flutes are situated in the zone where the ingot being cast contacts the mould walls, the flutes of the minimum depth spaced from the mould corners which is 0.05 to 0.4 of the wall width.
Figure 7:
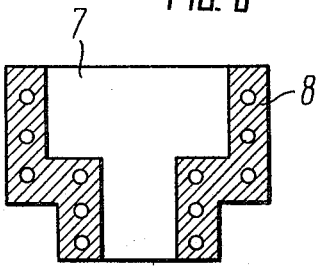
FIG. 7 is a section along the line VII—VII in FIG. 6.
Figure 8:
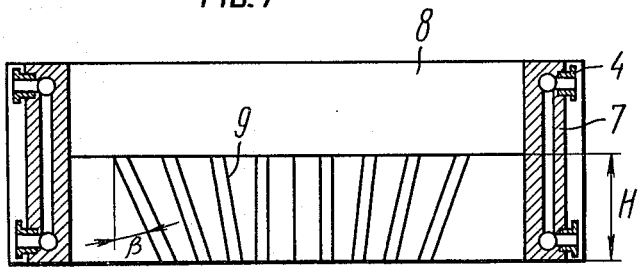
FIG. 8 is a section along the line VIII—VIII in FIG. 6.

In another embodiment of the mould, shown in FIG. 6 and 7, which has four walls, two narrower walls 7 are T-shaped and flat, and the other two, wider walls 8 are stepped. The walls are cooled similarly to those described above.

The chamber of the mould in its upper part is wider than in the lower part.

Figure 4:
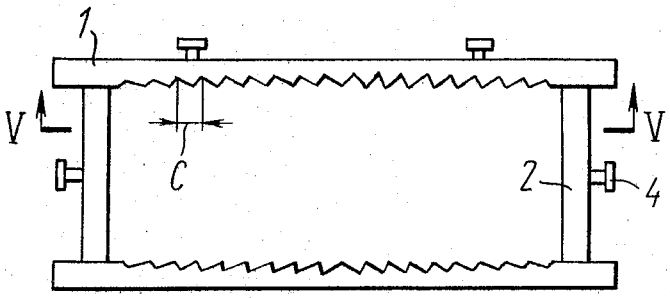
FIG. 4 is a plan view of a mould according to the present invention, wherein the flutes are spaced wider in the upper part of the mould wall than in its lower part.
Figure 5:
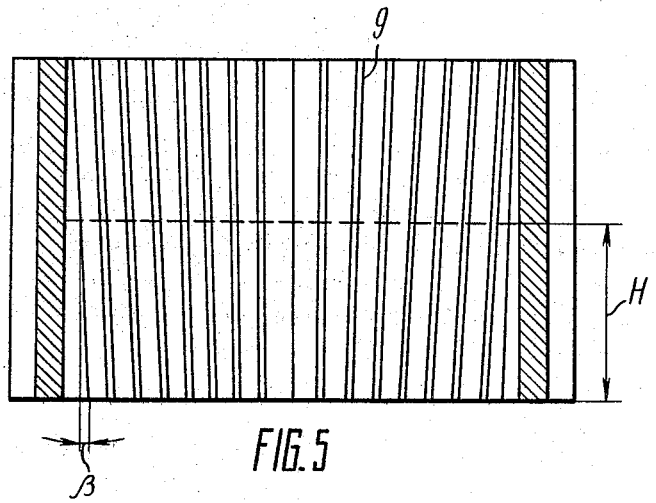
FIG. 5 is a section along the line V—V in FIG. 4.

The wider walls 8 are provided with flutes 9 which are made on the walls' portions forming the lower part of the mould. The flutes of the minimum depth are situated at a distance from the chamber corners which makes up 0.15 of the width of the walls 8. This distance, however, can range from 0.05 to 0.4 of the wall width. In the upper part of the fluted wall portion, the flutes 9 are spaced wider than in the lower part thereof (FIGS. 4 and 5).

An angle at which the flutes 9 are inclined to the mould longitudinal axis is determined from the formula $$tg\,\beta = (n \cdot c \cdot \alpha \cdot \Delta t/H)$$

where $n$ is the sequence number of a flute counted from the wall centre $c$ is the flute spacing $\alpha$ is the linear-shrinkage factor at freezing temperature $\Delta t$ is the drop in the ingot temperatures between the melt surface and the mold exit $H$ is the distance from the metal surface to the end of the mould The mould operates as follows.

A baseplate with a device for holding the ingot is placed under the mould's lower part, and consumable electrodes are introduced into the upper, wider part of the mould chamber (not shown).

A slag bath is then introduced in the mould by one of the known methods, and electric current is passed therethrough. The heat evolved from the slag melts the consumable electrodes, and the metal accumulates in the lower part of the mould where the ingot is formed.

In the course of casting, the level of the liquid metal is controlled by one of the conventional methods, so that when said level reaches the specified limit, the ingot and the mould begin to move relative to each other maintaining said specified level. The upper part of the ingot contains a bath of molten metal which is enclosed by a skin of solidified metal. The ingot is separated from the mould by a lining of solidified slag.

The evolution of heat in the mould along its perimeter is not uniform. The hottest zones are at the central portions of the wider walls, the coolest, in the corners. The flutes on the wall central portions make for increased heat removal from said hottest zones. With the depth of the flutes decreasing from the wall centre toward its sides, heat removal decreases in the same direction.

Since the ingot is initially formed in the mould when the latter is still stationary relative to the former, the ingot's lower part has time to cool before the relative movement begins (this cooling is also promoted by the removal of heat through the mould baseplate). While its temperature drops, the ingot shrinks along its narrower faces as well as wider ones.

The maximum shrinkage occurs at the ingot corners, and where the mould has fluted corners the ingot may get jammed therein. The jamming fails to occur where the mould walls have no flutes near the corners.

As it moves relative to the mould, the ingot cools and shrinks, whereupon any point on its surface tends downward and to the wall centre. That is why the flutes are made with a variable spacing to prevent the jamming of the ingot in the flutes of the mould while these move relative to each other.

We claim:

1. A mould for the electroslag casting of faceted metal ingots, comprising cooled walls, the internal surfaces of said walls forming a chamber for casting said ingots, and having longitudinal flutes made on said internal surfaces of at least two of said walls, said flutes having a depth which decreases in a horizontal direction from the middle of said walls to the corners of said mould.

2. A mould according to claim 1, wherein the depth of said flutes decreases gradually.

3. A mould according to claim 1, wherein the flutes on the middle of said wall are 1.1 to 5 times deeper than those on the sides thereof.

4. A mould according to claim 1, wherein said flutes are situated in the zone where the ingot being cast contacts said mould wall.

5. A mould according to claim 1, wherein the flutes having the minimum depth are made on said wall at a distance from the mould corners ranging from 0.05 to 0.4 of the wall width.

6. A mould according to claim 1, wherein said flutes having a spacing which in the upper part of the mould is greater than in its lower part.

* * * * *